US011548691B2

(12) United States Patent
Figgins et al.

(10) Patent No.: US 11,548,691 B2
(45) Date of Patent: Jan. 10, 2023

(54) CLAMSHELL CONTAINER MOVEMENT CONTROL STABILIZERS

(71) Applicant: Sonoco Development Inc., Hartsville, SC (US)

(72) Inventors: Travis L. Figgins, Zephyrhills, FL (US); Roger D. Hanna, Jr., Plant City, FL (US)

(73) Assignee: SONOCO DEVELOPMENT, INC., Hartsville, SC (US)

( * ) Notice: Subject to any disclaimer, the term of this patent is extended or adjusted under 35 U.S.C. 154(b) by 33 days.

(21) Appl. No.: 16/936,729

(22) Filed: Jul. 23, 2020

(65) Prior Publication Data

US 2022/0024654 A1 Jan. 27, 2022

(51) Int. Cl.

| | |
|---|---|
| ***B65D 43/16*** | (2006.01) |
| ***B65D 1/22*** | (2006.01) |
| ***B65D 51/16*** | (2006.01) |
| ***B65D 1/40*** | (2006.01) |

(52) U.S. Cl.

CPC ..... *B65D 43/162* (2013.01); *B65D 1/22* (2013.01); *B65D 1/40* (2013.01); *B65D 51/1611* (2013.01)

(58) Field of Classification Search

CPC ..... B65D 43/162; B65D 1/22; B65D 1/40; B65D 51/1611

USPC ..... 220/835, 4.22, 4.23

See application file for complete search history.

(56) References Cited

U.S. PATENT DOCUMENTS

| | | | | |
|---|---|---|---|---|
| 3,351,270 | A * | 11/1967 | Hohnjec | B65D 43/162 220/835 |
| 5,046,659 | A | 9/1991 | Warburton | |
| 5,456,379 | A | 10/1995 | Krupa | |
| 6,644,494 | B2 | 11/2003 | Hayes et al. | |
| 6,962,263 | B2 | 11/2005 | Cadiente et al. | |
| 8,091,731 | B2 * | 1/2012 | Kidd | B65D 43/162 220/788 |
| 8,261,933 | B2 | 9/2012 | Kidd et al. | |
| 8,381,944 | B2 * | 2/2013 | Strange | B65D 43/162 220/793 |
| 8,584,881 | B2 | 11/2013 | Hernandez et al. | |
| 9,027,780 | B2 * | 5/2015 | Attard | B65D 85/32 220/508 |
| 9,469,458 | B2 | 10/2016 | Padda et al. | |

(Continued)

FOREIGN PATENT DOCUMENTS

| | | | |
|---|---|---|---|
| GB | 2295815 | A | 6/1996 |
| KR | 20120078320 | A | 7/2012 |
| WO | 2012118724 | A1 | 9/2012 |

OTHER PUBLICATIONS

International Search Report and Written Opinion for International application No. PCT/US2021/041609 dated Nov. 3, 2021; 14 pages.

*Primary Examiner* — J. Gregory Pickett

*Assistant Examiner* — Niki M Eloshway

(74) *Attorney, Agent, or Firm* — Nelson Mullins Riley & Scarborough LLP

(57) ABSTRACT

In an embodiment, the invention comprises a container apparatus with a lateral stability rail system. At least one rail extends within the lid portion and at least one track extends through the base portion. The rail terminates in a tooth and the track terminates in a pocket. When the container is in a hingedly closed position, the at least one rail nests within the at least one track and the at least one tooth nests within the at least one pocket.

19 Claims, 16 Drawing Sheets

(56) References Cited

U.S. PATENT DOCUMENTS

| | | | | |
|---|---|---|---|---|
| 10,538,364 | B2 | 1/2020 | Croft | |
| 2001/0002268 | A1 | 5/2001 | Hanson et al. | |
| 2003/0192888 | A1* | 10/2003 | Chang | B65D 43/162 220/4.23 |
| 2005/0247709 | A1* | 11/2005 | Atkins | B65D 1/36 220/4.23 |
| 2010/0282752 | A1 | 11/2010 | Lam | |
| 2010/0320210 | A1* | 12/2010 | Cimmerer | B65D 75/22 220/367.1 |
| 2012/0031921 | A1* | 2/2012 | Cadiente | B65D 43/162 220/835 |
| 2014/0284346 | A1* | 9/2014 | McCumber | B65D 43/162 220/792 |
| 2017/0305616 | A1* | 10/2017 | Barbier | B65D 43/162 |
| 2017/0361980 | A1* | 12/2017 | Fosse | B65D 43/06 |
| 2018/0194523 | A1 | 7/2018 | Plummer et al. | |

* cited by examiner

CLAMSHELL CONTAINER MOVEMENT CONTROL STABILIZERS

FIELD OF THE INVENTION

This invention relates to movement control stabilizing features for packaging containers.

BACKGROUND

Many food products are stored and shipped in lightweight plastic containers, sometimes referred to as clamshell containers due to the hinge mechanism between the lid and base of the container. Containers such as these may house fruit, vegetables, bakery items, or the like.

Typically, such containers are constructed to facilitate automated packaging of the food products and include a locking mechanism to lock the container lid over and into the base portion. Because the container is intended to be used for shipping and display after packaging, it is desirable that the locking mechanism stay securely locked during shipment and subsequent handling. However, locking mechanisms that stay securely locked are often designed with relatively tight-fitting interlocking structures. While such tight-fitting interlocking structures provide a secure lock, they require relatively consistent alignment of the interlocking structures to engage properly. While the container is being processed in an automated food packing line, however, misalignments between the interlocking components may occur, resulting in a locking mechanism that is not fully engaged. Containers with locking mechanisms that are not fully engaged are prone to opening, causing spillage and loss of the food products stored within.

Likewise, containers such as these are often subject to various lateral movements during shipping, transportation, shelf placement, consumer consideration, etc. Lateral movements may be particularly likely when a plurality of containers are stacked one atop another, such as in a shipping crate. Lateral movements may disengage locking mechanisms, cause containers to open, and/or damage food products contained therein. As such, it is important that the container is constructed to minimize the effects of such lateral movement, to prevent opening of the container or damage to the container contents. Accordingly, through ingenuity and hard work, the inventors have developed a container with a novel rail system, wherein the container remains more effectively locked closed and is stable through lateral movements.

SUMMARY

In an embodiment, the invention comprises a container apparatus that includes a base section defining a base surface and one or more sidewalls extending upwardly from the base surface to define a container portion having an upper base periphery. A base flange projects outwardly from the upper base periphery in an embodiment. A lid section defines a lid surface and a lid periphery that aligns with the upper base periphery so that the lid surface and the container portion form an enclosure when the lid section is in a closed position relative to the base section. In an embodiment, the lid periphery fits over and around the upper base periphery. A lid flange projects outwardly from the lid periphery in an embodiment. The lid flange and the base flange may include respectively integrally formed locking components.

In an embodiment, the container apparatus comprises a rail system which has at least one rail which extends a length which is at least from the portion of the lid periphery which sits atop the upper base periphery to the lid flange and beyond (or above) the lid flange to define a tooth, wherein the at least one rail has a width and a depth and wherein the depth of the at least one rail extends perpendicular to the length of the at least one rail. The rail system additionally comprises at least one track which extends a length which is at least from the top surface of the upper base periphery to the base flange and beyond (or below) the base flange to define a pocket, wherein the at least one track has a width and a depth and wherein the depth of the at least one track extends perpendicular to the length of the at least one track. When the container is in a hingedly closed position, the at least one rail nests within the at least one track; and the at least one tooth nests within the at least one pocket.

In an embodiment, the contact portion is parallel to the top surface of the one or more sidewalls. In an embodiment, when the container is in a hingedly closed position the contact portion is seated atop the top surface of the one or more sidewalls. In an embodiment, when the container is in a hingedly closed position the lid flange is parallel to the base flange. In an embodiment, when the container is in a hingedly closed position the lid flange is seated atop the base flange. In an embodiment, the at least one rail extends away from the lid section and the at least one track is recessed into the base section. In an embodiment, the container assembly comprises at least two rails and/or at least two tracks. In an embodiment, the container assembly further comprises at least one locking mechanism. In an embodiment, the container assembly further comprises at least one rib disposed in the base section. In an embodiment, the container assembly additionally comprises a hinge connecting the lid section and the base section, wherein the at least one rail is disposed in the lid periphery portion opposite the hinge, and the at least one track is disposed in the upper base periphery portion opposite the hinge.

In an embodiment, at least one additional rail is disposed in the lid periphery portion adjacent the hinge and at least one additional track is disposed in the upper base periphery portion adjacent the hinge. In this embodiment, the at least one additional rail extends a length which is at least from the contact portion of the lid periphery to the lid flange, wherein the at least one additional rail has a width and a depth and wherein the depth of the at least one additional rail extends perpendicular to the length of the at least one rail. In this embodiment, the at least one additional track which extends a length which is at least from the top surface of the upper base periphery to the base flange, wherein the at least one additional track has a width and a depth and wherein the depth of the at least one additional track extends perpendicular to the length of the at least one track. When the container is in a hingedly closed position, the at least one additional rail nests within the at least one additional track.

In an embodiment, the at least one additional rail extends away from the lid section and the at least one additional track is recessed into the base section. In an embodiment, the container assembly comprises at least two additional rails and/or at least two additional tracks.

In an embodiment, the invention comprises a container apparatus having a base section defining a base surface and one or more sidewalls extending upwardly from the base surface to define a container portion having an upper base periphery, wherein the upper base periphery terminates at a top surface of the one or more sidewalls. The container apparatus may have a base flange projecting outward from the upper base periphery, and a hinge connecting the base section to a lid section. The lid section may define a lid surface and a lid periphery, wherein a contact portion of the lid periphery aligns with the top surface of the upper base periphery when the lid section is in a hingedly closed position relative to the base section. A lid flange may project outward from the lid periphery. The upper base periphery and the lid periphery may include an integrally formed rail system comprising: at least one rail which extends a length which is at least from the contact portion of the lid periphery to the lid flange and beyond (or above) the lid flange to define a lengthwise extending tooth, wherein the at least one rail has a width and a depth and wherein the depth of the at least one rail extends perpendicular to the length of the at least one rail, and wherein the at least one rail is disposed in the lid periphery portion opposite the hinge; and at least one track which extends a length which is at least from the top surface of the upper base periphery to the base flange and beyond (or below) the base flange to define a lengthwise extending pocket, wherein the at least one track has a width and a depth and wherein the depth of the at least one track extends perpendicular to the length of the at least one track, and wherein the at least one track is disposed in the upper base periphery portion opposite the hinge. When the container is in a hingedly closed position, the at least one rail nests within the at least one track, and the at least one tooth nests within the at least one pocket. In an embodiment, at least one additional rail is disposed in the lid periphery portion adjacent the hinge and at least one additional track disposed in the upper base periphery portion adjacent the hinge. In this embodiment, the at least one additional rail extends a length which is at least from the contact portion of the lid periphery to the lid flange, wherein the at least one additional rail has a width and a depth and wherein the depth of the at least one additional rail extends perpendicular to the length of the at least one rail; and the at least one additional track extends a length which is at least from the top surface of the upper base periphery to the base flange, wherein the at least one additional track has a width and a depth and wherein the depth of the at least one additional track extends perpendicular to the length of the at least one track. When the container is in a hingedly closed position, the at least one additional rail nests within the at least one additional track. In an embodiment, the container apparatus comprises at least two rails, at least two additional rails, at least two tracks, and at least two additional tracks. In an embodiment, the at least two rails are aligned with the at least two tracks, and the at least two additional rails are aligned with the at least two additional tracks.

The details of one or more embodiments of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements. Reference numerals in drawings subsequent to the drawings in which they are introduced may be omitted to avoid congestion in the drawings.

DETAILED DESCRIPTION

Figure 1:
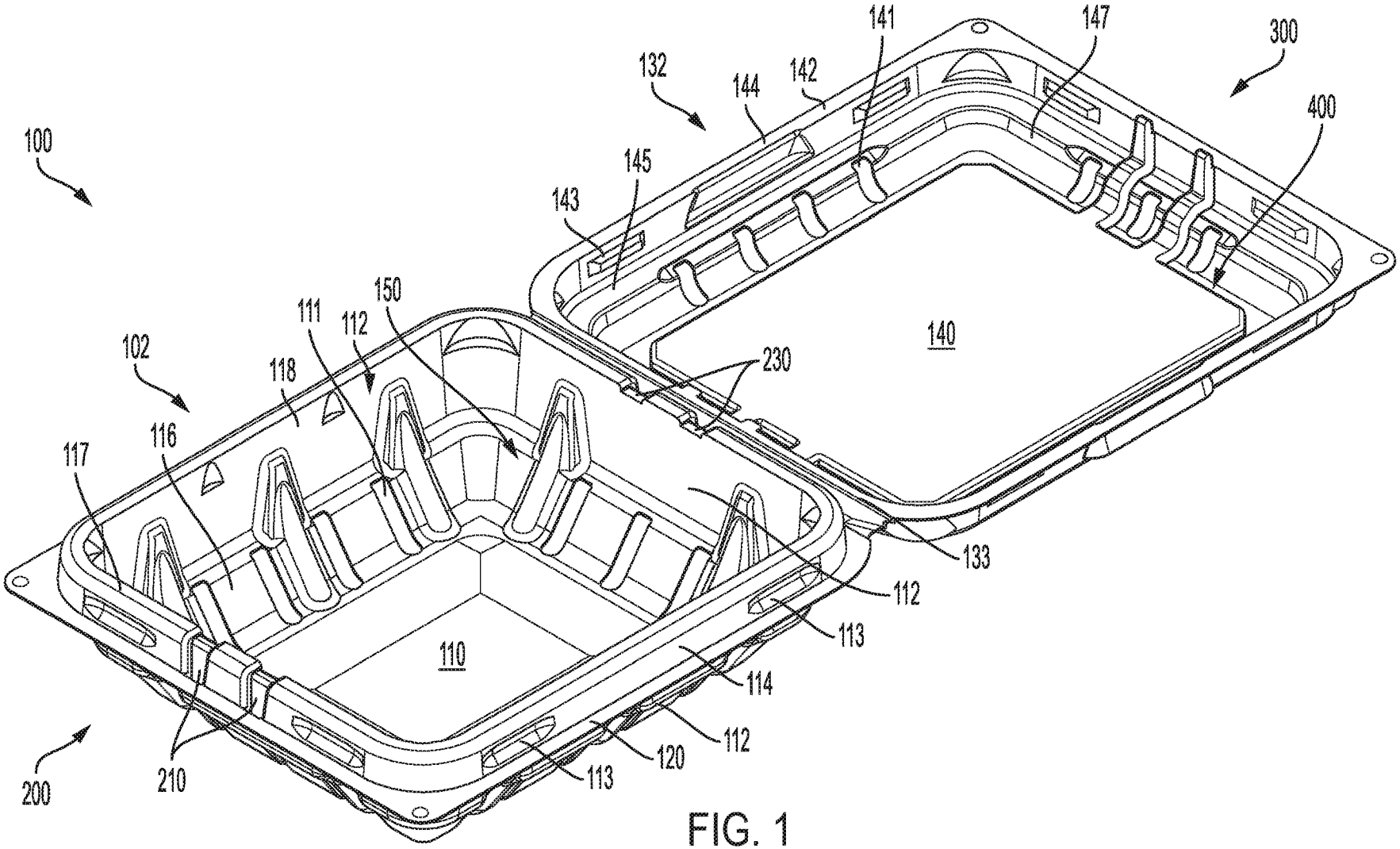
FIG. 1 is a perspective view of an embodiment of a container of the invention in an open configuration.

FIG. 1 is a top perspective view of an open container 100 with a rail system that includes a track component 200 and a rail component 300. In some implementations, the container 100 may be made of polyethylene terephthalate (PET) thermoplastic polymer resin. Other appropriate materials may also be used to construct the container.

The container 100 includes a base section 102 defining a base surface 110 and one or more sidewalls 112 extending upward from the base surface 110 to define a container portion having an upper base periphery 114. In an embodiment, the upper base periphery 114 extends outwardly and downwardly from a top surface 117 of the sidewall 112. In an embodiment, the top surface 117 may be flattened to define a surface which receives the lid section 132. In an embodiment, the top surface 117 is the uppermost portion of the base section 102. In such an embodiment, the base periphery 114 may appear to fold over the top surface 117 of the sidewall 112. For example, there may be a hollow space between the base periphery 114 and an outer surface of the sidewall 112, near the top surface 117 of the sidewall 112. In an embodiment, the base periphery 114 extends circumferentially about the sidewall(s) 112. In an embodiment, one or more inwardly or outwardly extending notches 113 may be disposed in the upper base periphery 114. In an embodiment, a base flange 120 may project outwardly from the upper base periphery 114. In an embodiment, the notches 113 are located between the base flange 120 and the top surface 117 of the sidewall 112. In an embodiment, the base flange 120 is disposed at a position on the upper base periphery 114 which is closest to the base surface 110—i.e. the lowermost point of the base periphery 114. In an embodiment, the upper base periphery 114 may comprise a collar that peripherally surrounds the upper portion 118 of the sidewall 112. In an embodiment, the upper base periphery 114 may be perpendicular to or substantially perpendicular to the base surface 110. In an embodiment, the upper base periphery 114 may be vertical or or vertical. In an embodiment, the width of the base flange 120 may be the same as or similar to the width of the top surface 117 of the sidewall 112.

Figure 2:
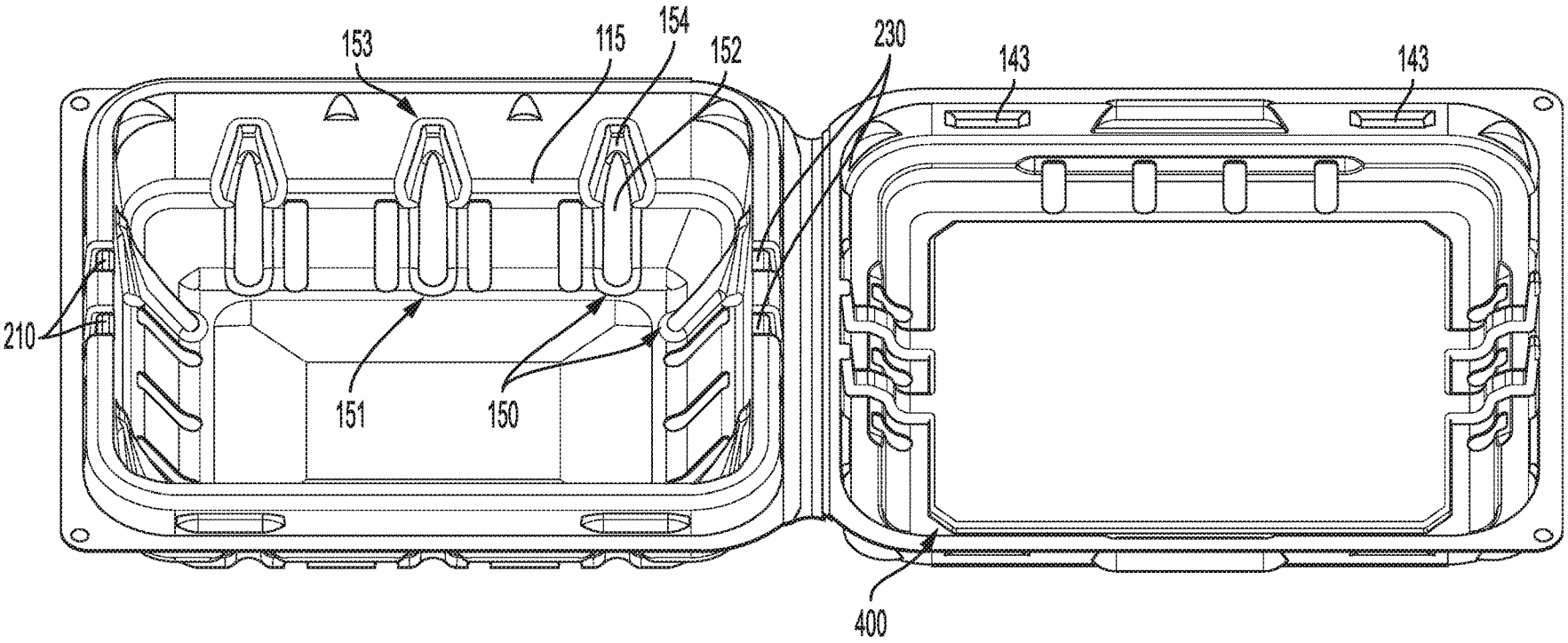
FIG. 2 is a perspective view of an embodiment of a container of the invention in an open configuration.

In an embodiment, the sidewalls 112 may comprise a lower portion 116 and an upper portion 118. The lower portion 116 may be disposed at an angle with respect to the base surface 110, connecting the base surface 110 and the upper portion 118. In an embodiment, the upper portion 118 may be vertical or substantially vertical. In an embodiment, the upper portion 118 may be perpendicular or substantially perpendicular to the base surface 110. In an embodiment (see FIG. 2), an intermediate portion 115 may be disposed between the lower portion 116 and an upper portion 118 of the sidewall 112. The intermediate portion 115 may comprise a plateau or ridge. In an embodiment, the intermediate portion 115 may be horizontal or substantially horizontal. In an embodiment, the intermediate portion 115 may be parallel or substantially parallel to the base surface 110.

One or more vents 111 may be disposed within the lower portion 116. The vents may allow for air to flow through the container, moisture to escape the container, and/or excess liquid to drip from the container, in certain embodiments. In some embodiments, a plurality of vents 111 is disposed within the lower portion 116 of each sidewall 112. In an embodiment, three or four vents may be disposed within the lower portion 116 of each sidewall.

In an embodiment, a lid section 132 defines a lid surface 140 and a lid periphery 142 that aligns with the upper base periphery 114 so that the lid section 132 and the base section 102 form an enclosure when the lid section 132 is in a closed position relative to the base section 102. The lid section 132 includes a lid flange 144 projecting outward from the lid periphery 142, in an embodiment. In an embodiment, the lid periphery 142 may surround the upper base periphery 114 when the container is in a closed position. In such an embodiment, the inner surface of the lid periphery 142 may contact the outer surface of the upper base periphery 114.

In an embodiment, one or more inwardly extending projections 143 may be disposed in the lid periphery 142. The lid periphery 142 projections 143 may align with and interconnect with the notches 113 in the base section 102 in an embodiment. In an embodiment, the notches 113 and projections 143 may serve as a locking mechanism for the container 100. Corresponding notches 113 and projections 143 may be disposed on one or more sides of the container 100. In an embodiment, corresponding notches 113 and projections 143 may be disposed in the left and right sidewalls as well as the front sidewall of the container (the hinge being disposed adjacent the rear sidewall). In an embodiment, two notches 113 and two corresponding projections 143 may be disposed in each of the left and right sidewalls as well as in the front sidewall of the container (the hinge being disposed adjacent the rear sidewall). The notches 113 and corresponding projections 143 may be aligned to allow removable interconnection therebetween. In an embodiment, when the container 100 is in the closed position, the corresponding notches 113 and projections 143 are interlocked. In an embodiment, the projections 143 in the lid periphery 142 project inwardly, toward the interior of the container 100. In an embodiment, the notches 113 in the upper base periphery 114 are recessed inwardly, toward the interior of the container 100. It should be understood that the lid section 132 could comprise recessed notches and the base periphery 114 could comprise corresponding projections, in an embodiment.

Figure 5:
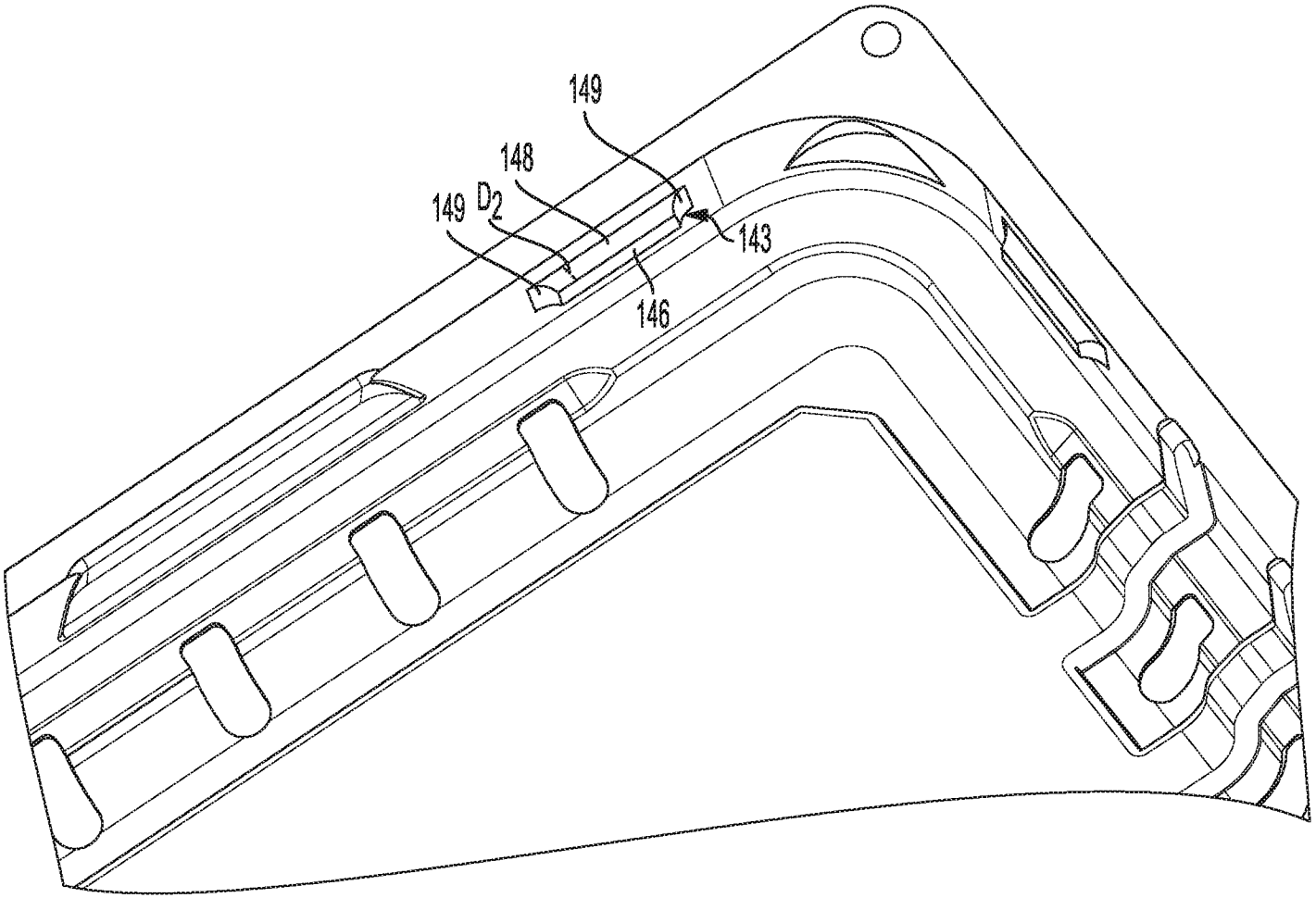
FIG. 5 is an exploded perspective view of an embodiment of a container of the invention in an open configuration.

In an embodiment, the notches 113 and projections 143 are sized and configured such that they can be snap-fit together. In this embodiment, the notches 113 and projections 143 may each comprise elongated three-dimensional rectangles or ovals. In an embodiment, the projections 143 may each comprise three-dimensional rectangles formed integrally in the lid periphery 142. The projections 143 may have a depth $D_2$, from the inner surface of the lid periphery 142 to the inner surface 146 of the projection 143 (FIG. 5). The projections 143 may have two elongated sidewalls 148 and two non-elongated sidewalls 149. Two or more of the sidewalls 148, 149 may be tapered inwardly, such that they are angular as compared to the lid periphery 142 and/or the inner surface 146 of the projection 143. The perimeter of the inner surface 146 of the projection 143 may be less than the perimeter of the juncture between the sidewalls 148, 149 and the lid periphery 142. Such a configuration may allow the projections to more easily snap-fit into the notches 113.

In an embodiment, the lid section 132 comprises a sidewall portion 147 between the lid periphery 142 and the lid surface 140. In an embodiment, the sidewall portion 147 of the lid section 132 may be vertical or substantially vertical. In an embodiment, the sidewall portion 147 of the lid section 132 may be perpendicular or substantially perpendicular to the lid surface 140. In an embodiment, the juncture between the sidewall portion 147 and the lid periphery 142 and/or the lid surface 140 may be curved or gradual. In an embodiment, the sidewall portion 147 of the lid section 132 may circumvent the lid surface 140. In an embodiment, the lid periphery 142 may circumvent the sidewall portion 147.

In an embodiment, a contact portion 145 of the lid section 132 may be disposed between the sidewall portion 147 and the lid periphery 142. The contact portion 145 may be horizontal or substantially horizontal. The contact portion 145 may comprise a shelf, plateau or ridge. In an embodiment, the contact portion 145 may be parallel or substantially parallel to the lid surface 140. In an embodiment, the contact portion 145 may be sit atop the top surface 117 of the base portion 102 when the container is in a closed position. In an embodiment, the contact portion 145 may nest with top surface 117 of the base portion 102 when the container is in a closed position. In such an embodiment, the profile of the contact portion 145 should be compatible with the profile of the top surface 117 of the base section 102. That is, if the top surface 117 of the base section portion 102 is a flat horizontal surface, so should be the contact portion 145 of the lid section 132. Likewise, if the top surface 117 of the base section portion 102 is curved or angled, the contact portion 145 of the lid section 132 should be complimentarily curved or angled.

One or more vents 141 may be disposed within the sidewall portion 147 and/or the contact portion 145. The vents may allow for air to flow through the container and/or moisture to escape the container, in certain embodiments.

In an embodiment, the lid section 132 and the base section 102 are flexibly connected, e.g., by a living hinge 133, so that the lid section 132 can rotate over the base section 102 to form an enclosure. The hinge 133 allows the lid section 132 to pivot between an open and closed position. In an embodiment, the base section 102 and the lid section 132 are formed as a one-piece, unitary construction.

In an embodiment, the container 100 comprises one or more ribs 150 disposed along the sidewalls 112 of the base section 102. The ribs 150, in an embodiment, may have a first end 151 adjacent the base surface 110 and a second end 153 adjacent the sidewalls 112 of the base section 102*b* (see FIG. 2). More particularly, the ribs 150 may initiate at the base section 102, may be integral with the lower portion 116 of the sidewall 112, and may terminate along the upper portion 118 of the sidewall 112. In an embodiment, the ribs 150 are integrally formed in the sidewall 112.

Figure 3:
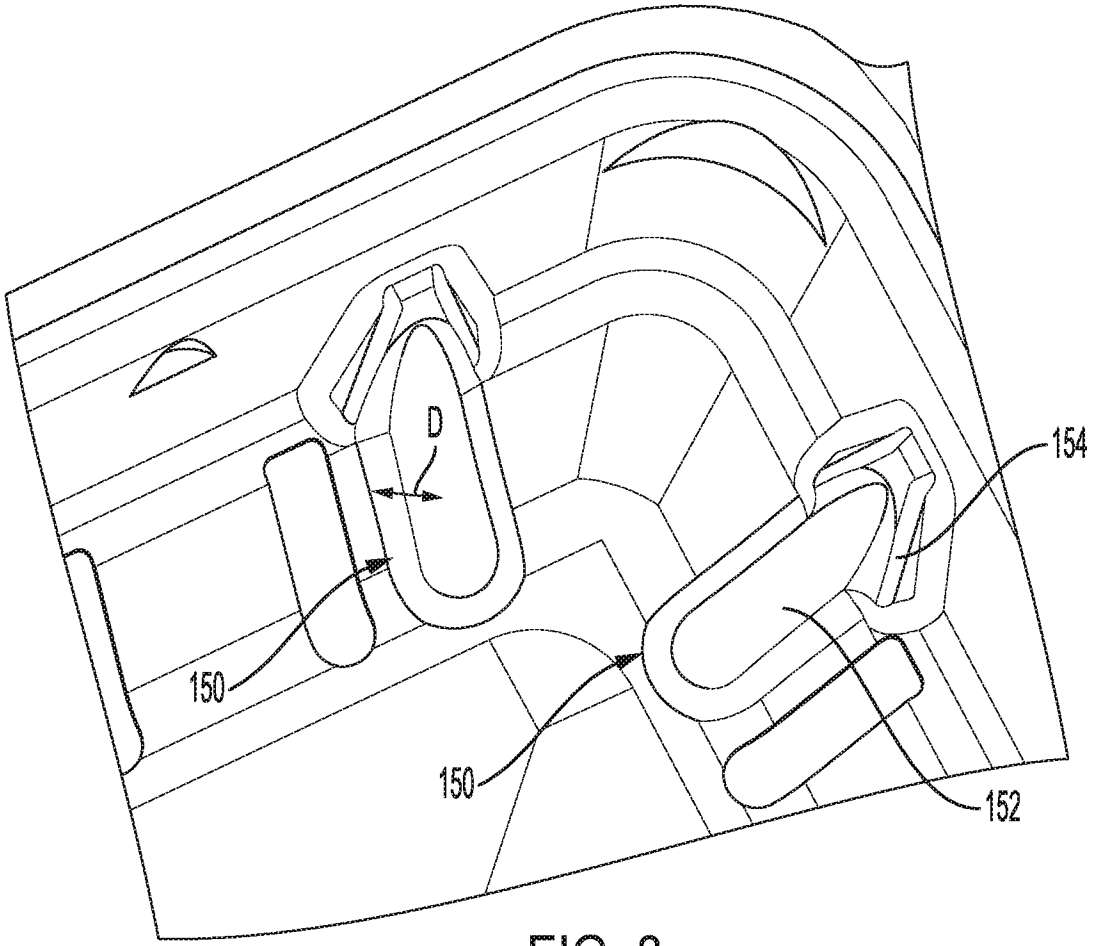
FIG. 3 is an exploded perspective view of an embodiment of a container of the invention in an open configuration.

In an embodiment, the ribs 150 may comprise a column portion 152 and a stabilization portion 154. In an embodiment, the column portion 152 of the ribs 150 may be generally semi-cylindrical in shape. In an embodiment, the column portion 152 may comprise a half cylinder. In an embodiment, the column portion 152 is hollow. That is, the column portion 152 may be convex on the interior of the container and concave on the exterior of the container. In an embodiment, the column portion 152 is disposed in an angular manner. In an embodiment, the column portion 152 has the same angle as the lower portion 116 of the sidewall 112. In an embodiment, the column portion 152 begins at the first end 151. In an embodiment, the column portion 152 may comprise a certain depth D (FIG. 3), measured from the lower portion 116 of the sidewall 112 to the innermost point of the column portion 152, with regard to the interior of the container.

Figure 4:
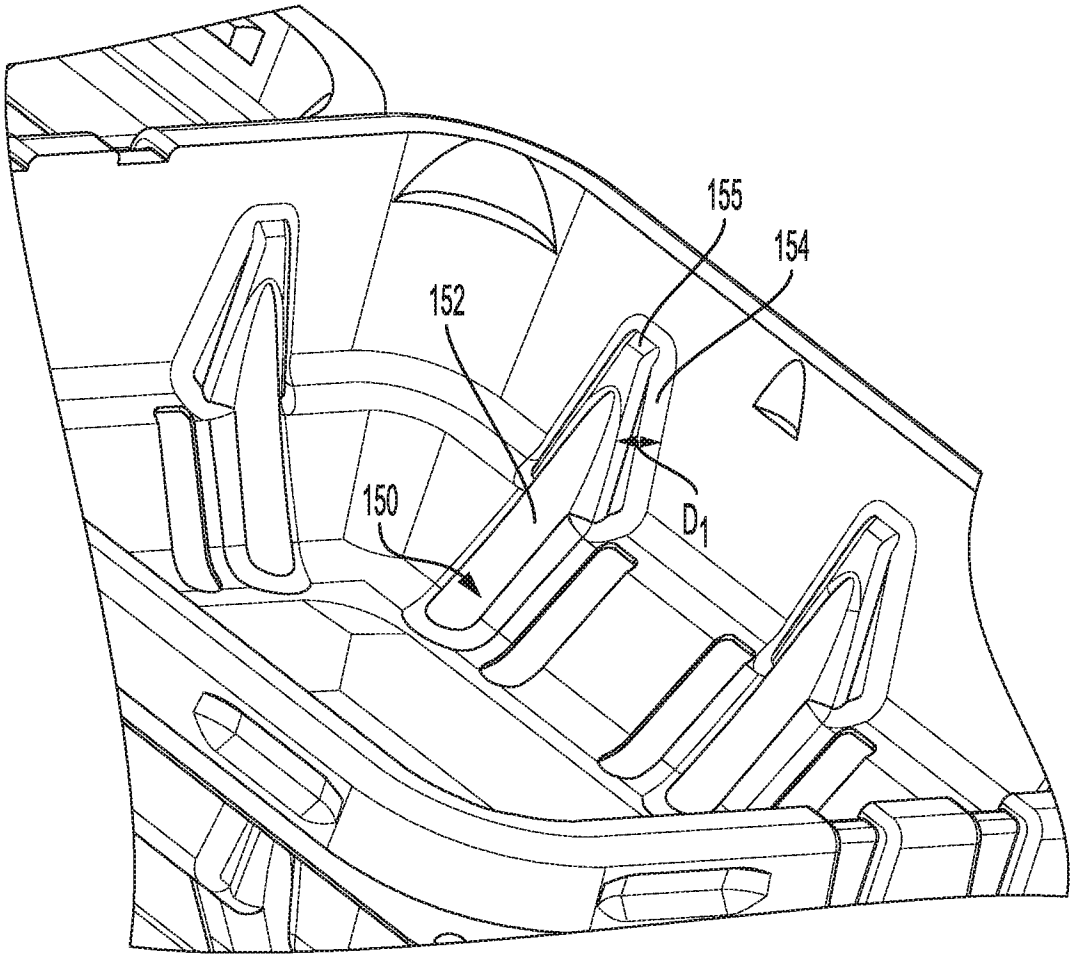
FIG. 4 is an exploded perspective view of an embodiment of a container of the invention in an open configuration.

In an embodiment, the column portion 152 terminates, at its top end, at the stabilization portion 154. In an embodiment, the stabilization portion 154 may comprise a geometrical shape. In an embodiment, the stabilization portion 154 generally comprises a three-dimensional triangular shape. In an embodiment, the stabilization portion 154 generally comprises a three-dimensional flattened triangular shape (i.e. the top point of the triangle may be flattened). In an embodiment, the stabilization portion 154 is disposed adjacent the intermediate section 115 and the upper portion 118 of the sidewall 112. In this embodiment, the base of the triangular shape of the stabilization portion 154 may be disposed within the intermediate section 115 of the sidewall 112. In an embodiment, the top surface 155 of the stabilization portion 154 may be angled inwardly into the container 100 (see FIG. 4). That is, the top surface 155 of the stabilization portion 154 may not be disposed parallel to the base surface 110, but may instead be angular. In an embodiment, the stabilization portion 154 has a depth $D_1$ as shown in FIG. 4, as measured between the upper portion 118 of the sidewall 112 and an inside edge of the stabilization portion 154.

The ribs 150 may improve the structural rigidity of the container, in an embodiment. Further, the ribs 150 may improve the crush resistance of the container to a force applied from above or below. The ribs 150 may be formed integrally with the container 100, in an embodiment. In an embodiment, the ribs 150 may be generally parallel to one another. Each sidewall 112 may have at least one rib 150, in an embodiment. In a particular embodiment, the left and right sidewalls 112 each comprise three ribs 150 and the front and rear sidewalls 112 (with the hinge being adjacent the rear sidewall) each comprise two ribs 150. In an embodiment, the ribs 150 may be centered and/or spaced equidistance from one another and from the interior edges of the container. In an embodiment, the ribs 150 disposed in the front and rear sidewalls 112 may be symmetrical in relation to the container 100 but not centered along the respective sidewall 112. In an embodiment, the container 100 comprises ten ribs 150.

In an embodiment, a central portion 400 of the lid surface 140 may extend some distance toward the interior of the container 100, when the container 100 is in a closed position. For example, a generally square or rectangular portion of the lid surface 140 may be used for labeling, stickers, or viewability of the product contained therein, on the exterior surface. In an embodiment, this central portion 400 of the lid surface 140 may be recessed on the exterior side of the lid. Thus, such labeling or stickers may be easily positionable on the recessed exterior surface. In an embodiment, the central portion 400 has a depth $D_3$.

Figure 6:
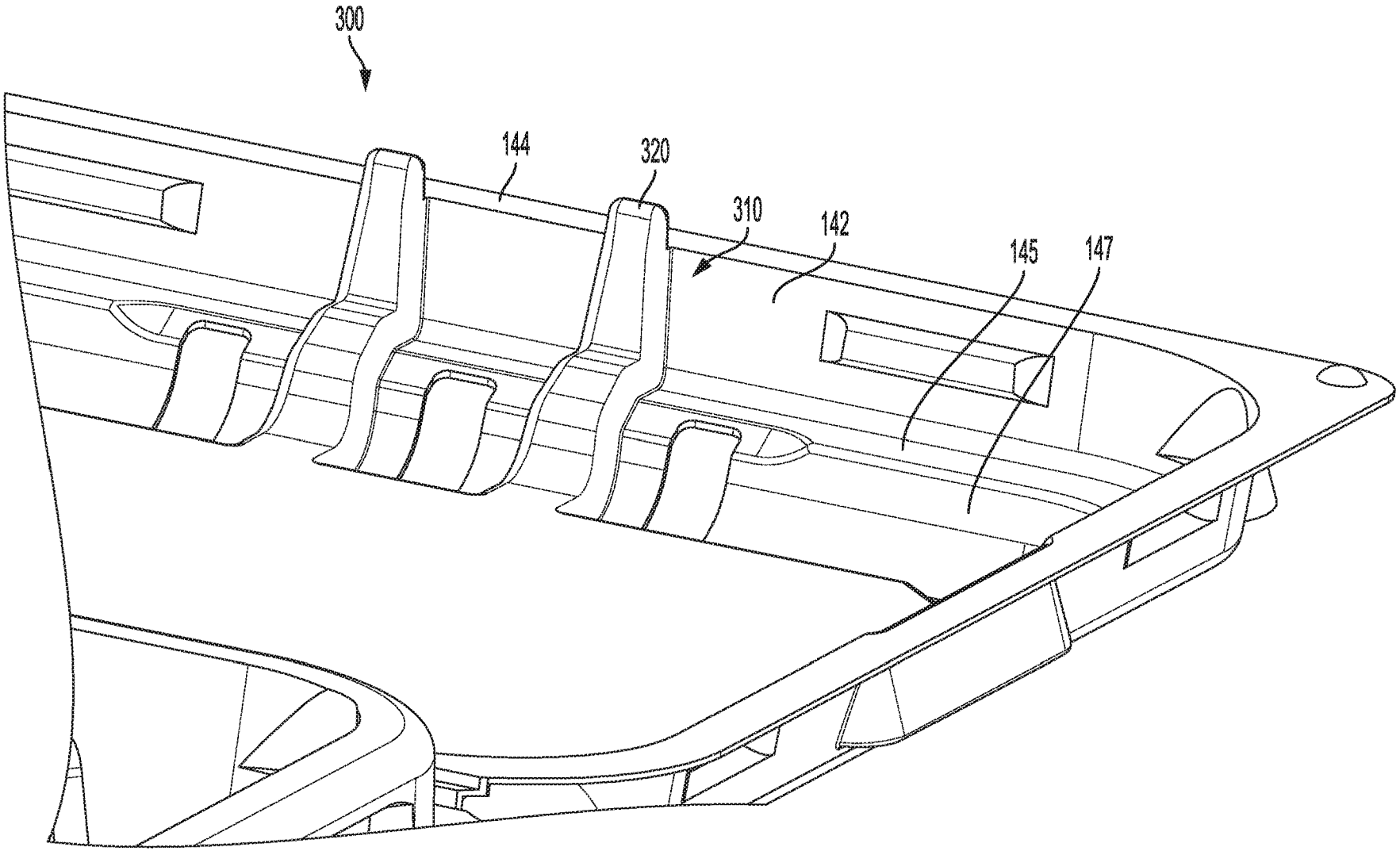
FIG. 6 is an exploded perspective view of an embodiment of a container of the invention in an open configuration.

In an embodiment, the container 100 comprises a track component 200 and a rail component 300. The rail component is shown in FIG. 6. In an embodiment, the rail component comprises one or more rails 310 formed in the lid section 132. The rails 310 may be elongated and may be elevated or extended toward the interior of the container 100 when the container 100 is in a closed position. In an embodiment, the rails 310 each have a depth $D_4$. In an embodiment, the rails 310 are formed such that the depth $D_4$ of the rails 310 is equivalent to the depth $D_3$ of the central portion 400 of the lid surface 140.

Figure 9:
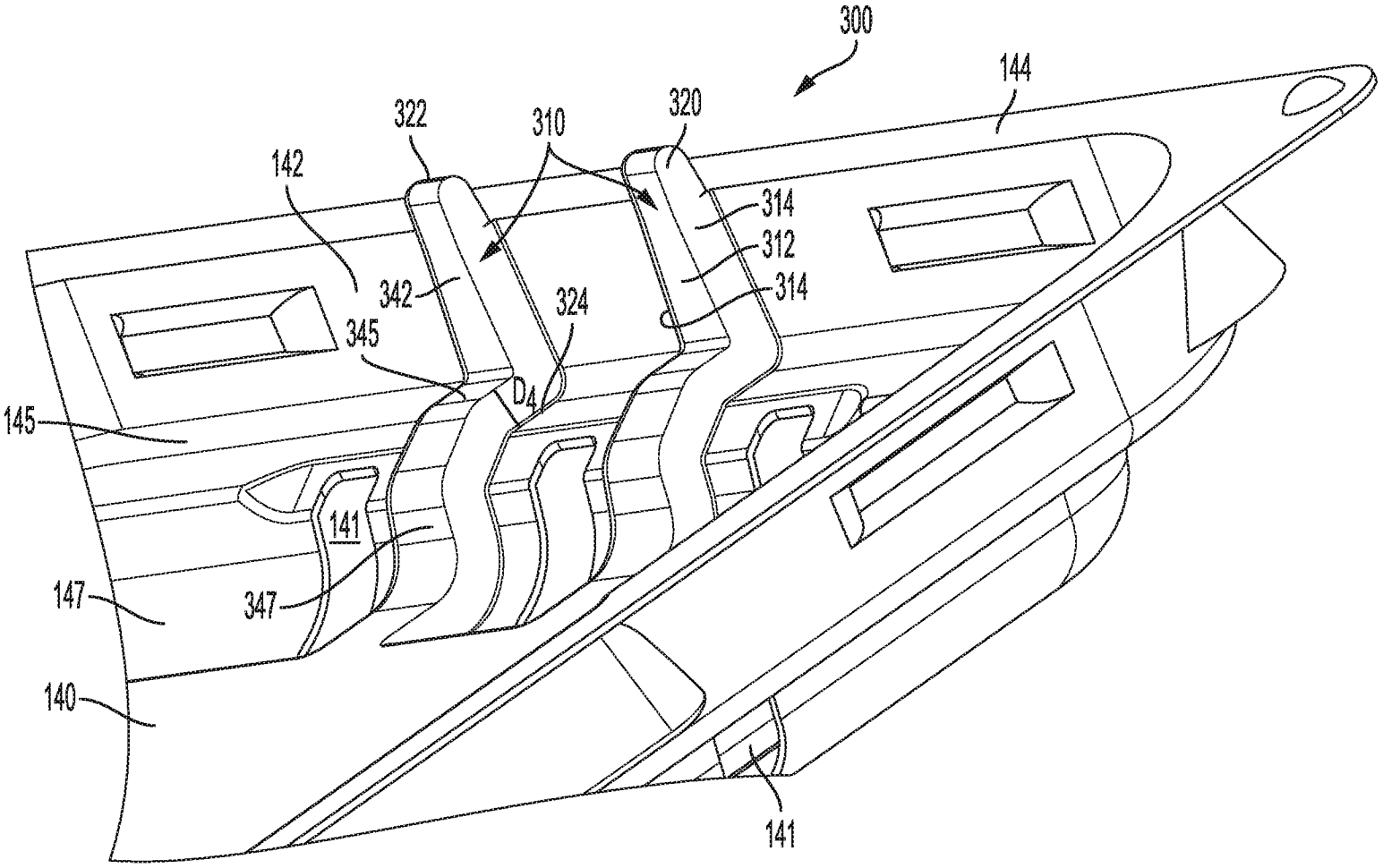
FIG. 9 is an exploded perspective view of an embodiment of a container of the invention in an open configuration.

In an embodiment, the rails 310 have a flattened face or front surface 312 (see FIG. 9). That is, rather than a rail that is rounded or angled, the rail 310 may have a flat face 312. In other embodiments, the rails 310 may be rounded (i.e. semi-circular, cylindrical) or angular (i.e. triangular). In certain embodiments, the rails 310 may be irregular in profile.

Figure 7:
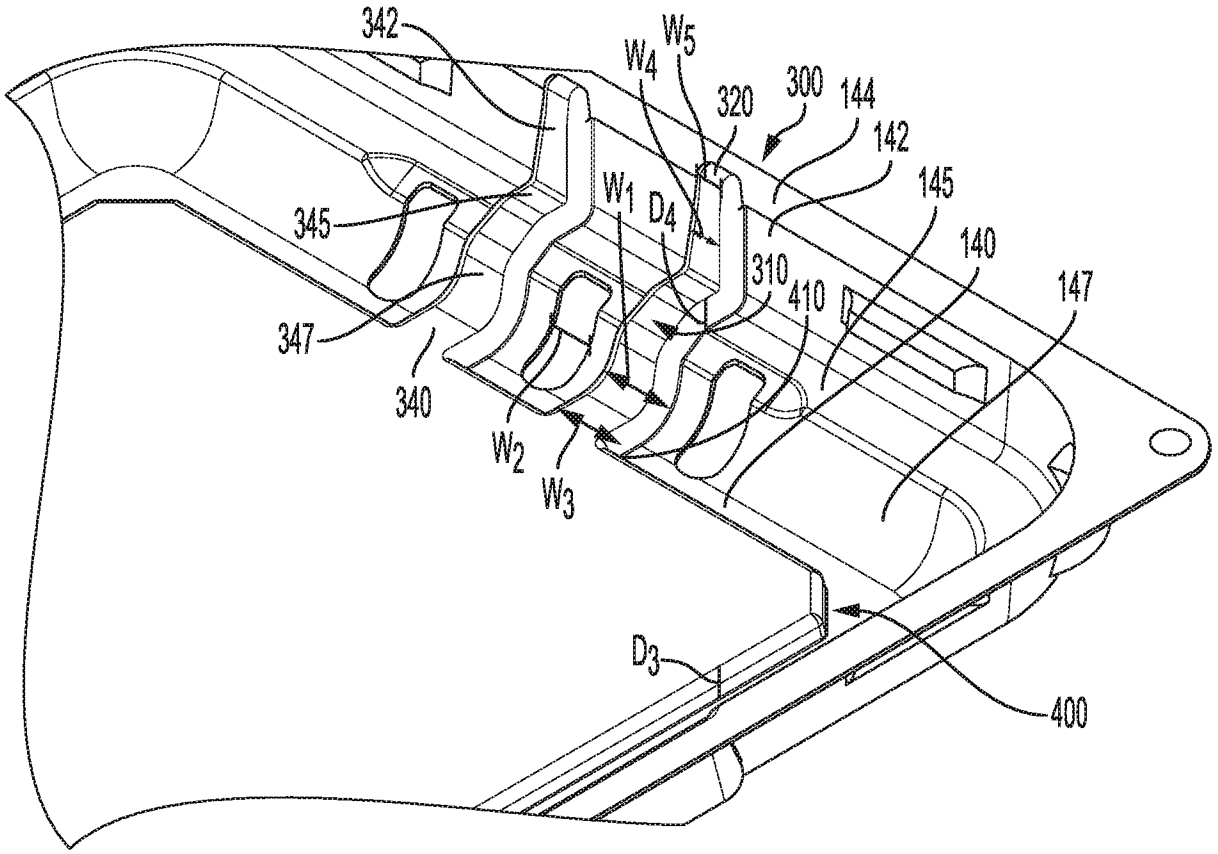
FIG. 7 is an exploded perspective view of an embodiment of a container of the invention in an open configuration.
Figure 8:
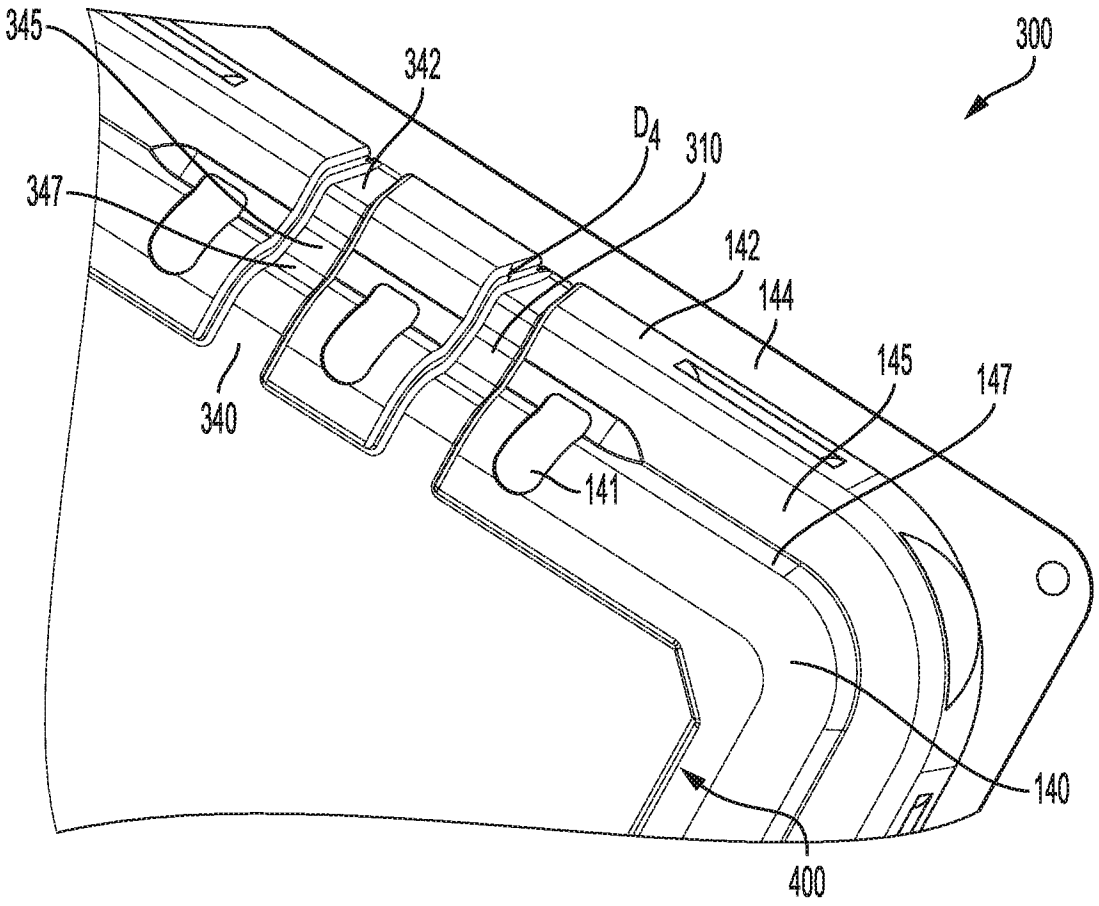
FIG. 8 is an exploded perspective view of an embodiment of a container of the invention in an open configuration.

Referring to FIG. 7, in an embodiment, the rails 310 may initiate at an edge 410 of the central portion 400 of the lid surface 140 furthest from the hinge 133. In this embodiment, the rails 310 may be disposed within the lid surface 140, the sidewall portion 147, the contact portion 145, and the lid periphery 142. In an embodiment, the rails 310 may be recessed on the exterior side of the lid section 132 (see FIG. 8). In an embodiment, the rails 310 may be shaped and configured to be parallel to the lid surface 140, the sidewall portion 147, the contact portion 145, and the lid periphery 142, respectively. That is, the rails 310 may parallel the contours of the lid surface 140, the sidewall portion 147, the contact portion 145, and/or the lid periphery 142. In an embodiment, each rail 310 may have a lid surface portion 340, a sidewall portion 347, a contact portion 345, and a lid periphery portion 342 (see FIG. 7).

In an embodiment, the lid surface portion 340 of the rail 310 may extend away from the lid surface 140 (toward the interior of the container when the container is in a closed position), the rail sidewall portion 347 may extend away from the sidewall portion 147, the rail contact portion 345 may extend away from the contact portion 145, and the rail lid periphery portion 342 may extend away from the lid periphery 142, thereby creating a depth by the amount each respective portion extends away from the respective lid element. In each case, the extension depth may be consistent across the rail 310. In other embodiments, the extension depth may vary across the rail 310.

In an embodiment, the rails 310 each have a rail width $W_1$. In an embodiment, the rail width $W_1$ of each rail 310 is equal to or greater than a vent width $W_2$ of the vent 141. In an embodiment, the rail width $W_1$ of each rail 310 decreases as the rail 310 extends from the lid surface portion 340 to the rail lid periphery portion 342. In this embodiment, the rail width $W_3$ of the rail lid surface portion 340 may be greater than the rail width $W_4$ of the lid periphery portion 342 of the rail 310. The width of the rails 310 may taper gradually such that the lid periphery portion 342 of the rail 310 is narrower than the rail lid surface portion 340, the rail sidewall portion 347, and the rail contact portion 345.

In an embodiment, the rails 310 are integrally formed with the container 100. In an embodiment, each rail 310 may have a front surface 312 and two side surfaces 314 (see FIG. 9). The size of the side surfaces 314 may correspond to the depth D4 of the rails 310. In other embodiments, each rail 310 may have one rounded semi-circular (half cylindrical) surface. Other shapes and configurations are encompassed as well.

In an embodiment, the rails 310 may extend vertically beyond and/or above the lid flange 144 (see FIG. 7) (or other uppermost surface when the container is in an open configuration). In this embodiment, the teeth 320 of the rails 310 which extend above the lid flange 144 have a hollow interior. In an embodiment, the teeth 320 may have a rounded distal surface 322. In an embodiment, the width $W_5$ of the teeth 320 is less than the rail width $W_3$ of the rail lid surface portion 340, the rail width $W_4$ of the rail lid periphery portion 342, or the width of any other portion of the rail 310. That is, the teeth 320 may be narrower than the lid periphery portion 342, the lid surface portion 340, the sidewall portion 347, and the contact portion 345 of the rail 310.

In an embodiment, at least two rails 310 are formed in the lid section 132, on the wall opposite the hinge 133. In an embodiment, at least two additional rails 330 are formed in the lid section 132, on the sidewall nearest the hinge 133. In this embodiment, the additional rails 330 may be disposed adjacent the hinge 133.

In an embodiment, the additional rails 330 may initiate at an edge 410 of the central portion 400 of the lid surface 140 furthest from the hinge 133. In this embodiment, the additional rails 330 may be disposed throughout the lid surface 140, the sidewall portion 147, the contact portion 145, and the lid periphery 142. In an embodiment, the additional rails 330 may be recessed on the exterior side of the lid section 132, just as the rails 310 are recessed. In an embodiment, the additional rails 330 may be shaped and configured to be parallel to the lid surface 140, the sidewall portion 147, the contact portion 145, and the lid periphery 142. That is, the additional rails 330 may parallel the contours of the lid surface 140, the sidewall portion 147, the contact portion 145, and/or the lid periphery 142. Just as the rails 310, in an embodiment, each additional rail 330 may have a lid surface portion, a sidewall portion, a contact portion, and a lid periphery portion. Further, the shape, size, configuration, and disposition of each of the additional rails 330 may be the same as or similar to that of the rails 310.

Unlike the rails 310, however, the additional rails 330 may terminate at the lid flange 144 (or uppermost surface of the lid section 102 when the container is in an open configuration). That is, in an embodiment, the additional rails 330 do not extend vertically beyond and/or above the lid flange 144 and are, instead, flush with the lid flange 144. In this embodiment, the additional rails 330 do not have teeth. In an embodiment, the additional rails 330 have a top surface 332 which is flush with the lid flange 144.

Figure 11:
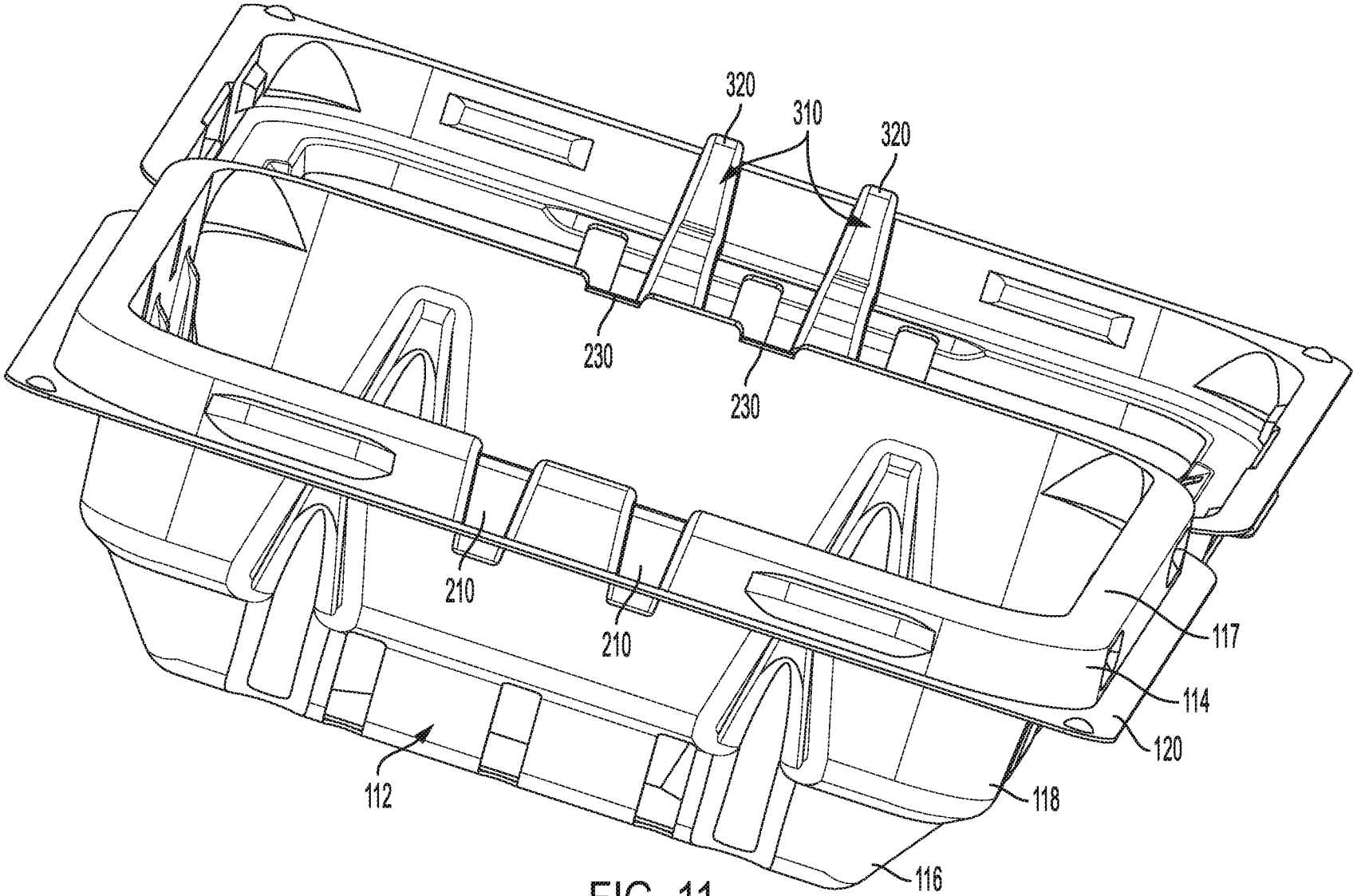
FIG. 11 is an exploded perspective view of an embodiment of a container of the invention in an open configuration.

In an embodiment, the container 100 comprises a track component 200 which corresponds to the rail component 300. In an embodiment, the track component 200 is disposed on the front sidewall 112 of the container 100, the sidewall opposite the hinge 133. Referring to FIG. 11, the track component 200 may be a female counterpart to the male rail component 300. In an embodiment, the track component 200 comprises at least one track 210 formed integrally into the container 100. In an embodiment, the invention comprises two tracks 210.

The tracks 210 may be elongated and may be recessed into the container sidewall 112, in an embodiment. In an embodiment, the tracks 210 each have a depth $D_5$. In an embodiment, the tracks 210 are formed such that the depth $D_5$ of the tracks 210 is equivalent or substantially equivalent to the depth $D_4$ of the rails 310.

Figure 10:
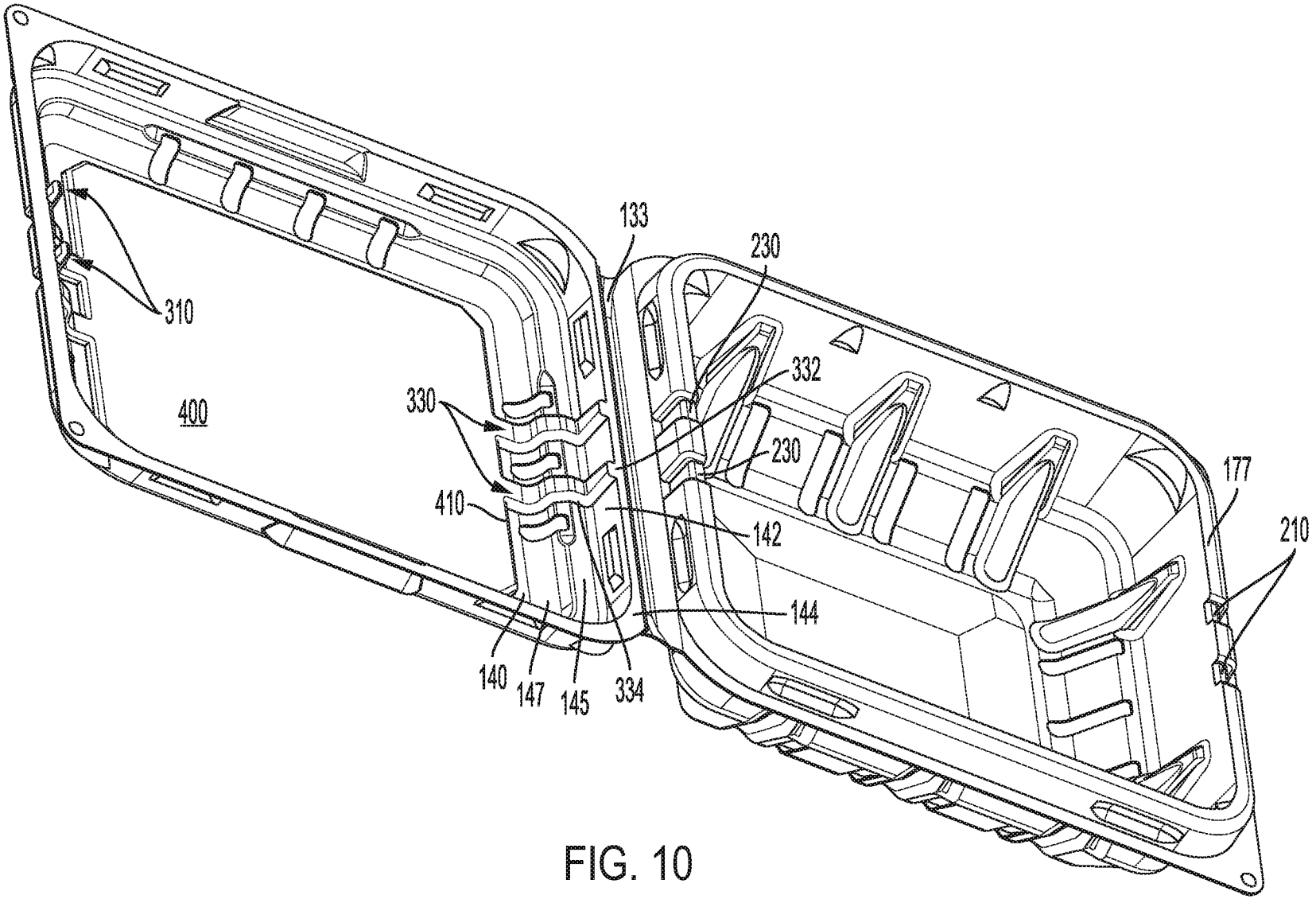
FIG. 10 is a perspective view of an embodiment of a container of the invention in an open configuration.
Figure 13:
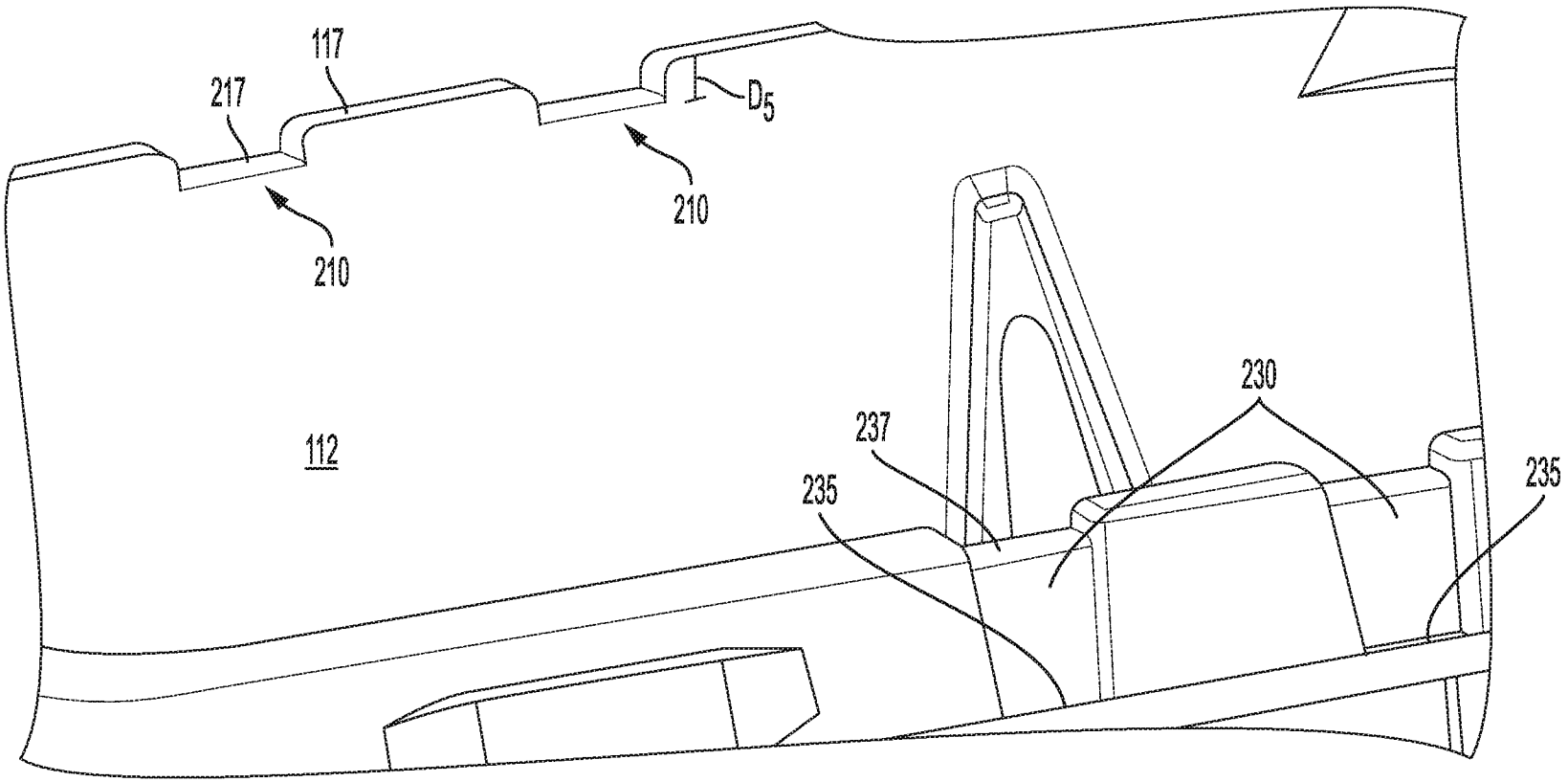
FIG. 13 is an exploded perspective view of an embodiment of a container of the invention in an open configuration.

Referring to FIG. 10, in an embodiment, the tracks 210 may be formed into and initiate at the top surface 117 of the sidewall 112. In this embodiment, the tracks 210 may comprise a recessed portion of the sidewall 112 top surface 117 (see exploded view in FIG. 13). The corners between the tracks 210 and the top surface 117 may be rounded as shown, may be squared, or may be angular. As shown in FIG. 11, the tracks 210 may continue through the upper base periphery 114. In an embodiment, the tracks 210 may extend outwardly on the opposite, exterior side (i.e. the underside) of the upper base periphery 114.

In an embodiment, the top surface 217 of the tracks 210 may be shaped and configured to be parallel to the top surface 117 of the sidewall 112 and the upper base periphery 114, respectively. That is, the tracks 210 may parallel the contours of the top surface 117 of the sidewall 112 and the upper base periphery 114. In an embodiment, each track 210 may have a top surface portion 217 and an upper base periphery portion 214.

In an embodiment, the tracks 210 are integrally formed with the container 100. In an embodiment, each track 210 may have a face surface 212 and two side surfaces 216 (see FIG. 12). The side surfaces 216 may correspond to the depth $D_5$ of the tracks 210.

In an embodiment, the track top surface portion 217 may be recessed into the top surface 117 of the sidewall 112 and the track upper base periphery portion 214 may be recessed into the upper base periphery 114 of the sidewall 112. In each case, the recess depth may be consistent across the track 210. In other embodiments, the recess depth may vary across the track 210.

Figure 12:
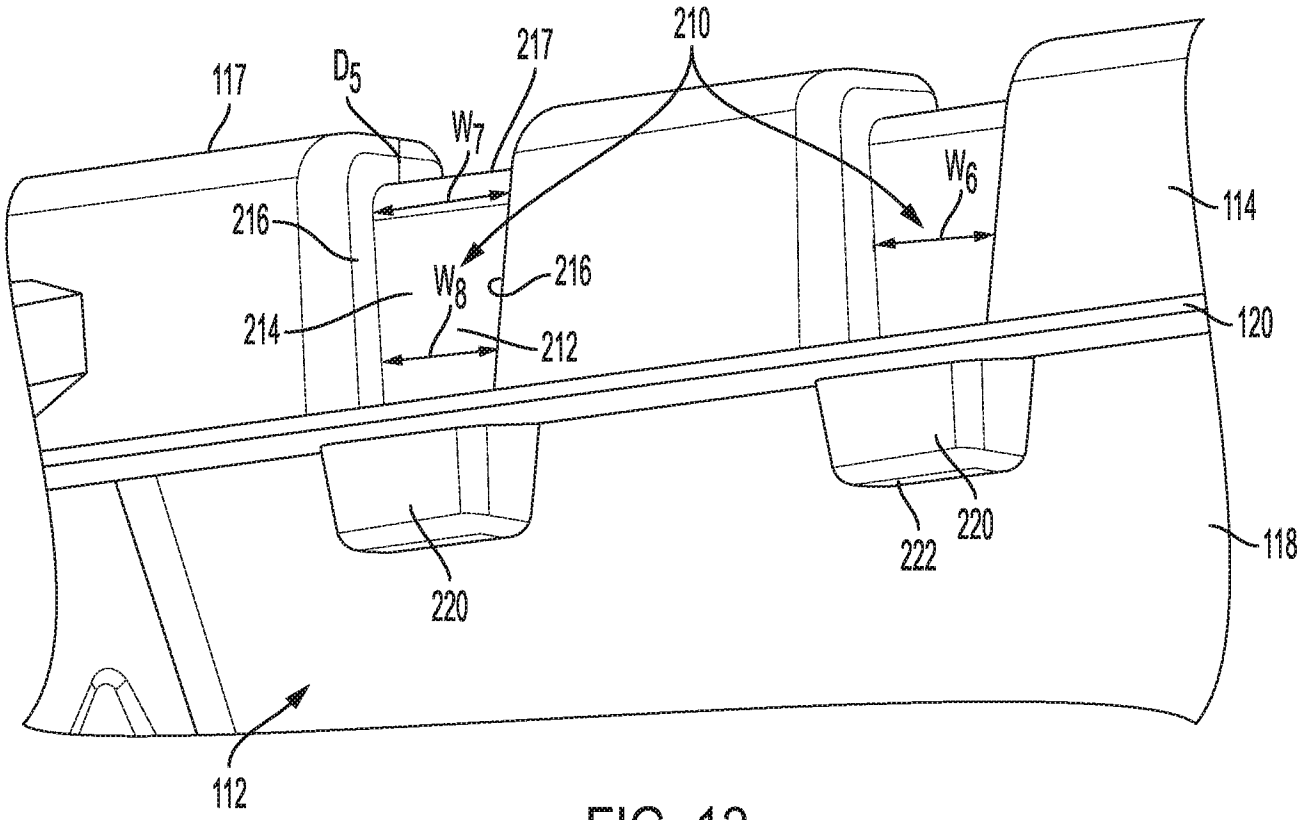
FIG. 12 is an exploded perspective view of an embodiment of a container of the invention in an open configuration.

In an embodiment shown in FIG. 12, the tracks 210 each have a width $W_6$. In an embodiment, the width $W_6$ of each track 210 is equal to or greater than a width $W_1$ of the rails 310. In an embodiment, the width $W_6$ of each track 210 is equal to or greater than a width $W_2$ of the vent 141. In an embodiment, the width $W_6$ of each track 210 decreases from the top surface portion 217 to the upper base periphery portion 214. In this embodiment, the width $W_7$ of the top surface portion 317 may be greater than the width $W_8$ of the upper base periphery portion 214. The width of the tracks 210 may taper gradually such that the upper base periphery portion 214 of the track 210 is narrower than the track top surface portion 217.

In an embodiment, the tracks 210 have a flattened face or front surface 212 (see FIG. 9). That is, rather than a track that is rounded or angled, the track 210 may have a flat face 212. In other embodiments, the tracks 210 may be rounded (i.e. semi-circular, half-cylindrical) or angular (i.e. triangular). In certain embodiments, the tracks 210 may be irregular in profile. Other shapes and configurations are encompassed as well.

In an embodiment, the tracks 210 may each terminate, opposite the top surface 117, in a pocket 220. The tracks 210 may continue through upper base periphery portion 114, through the position of the flange 120, and may extend beyond and/or below the flange 120 (i.e. lower than the flange) to form a pocket 220. The pocket 220 may be disposed adjacent the base flange 120, in an embodiment. The pocket 220 may be disposed into and through the base flange 120, in an embodiment. While the pockets are discussed in relation to the flange 120, the pocket 220 may alternatively be positioned above or below the flange 120, in any position. Likewise, the pocket 220 may be present even in embodiments which do not comprise a flange 120.

Figure 14:
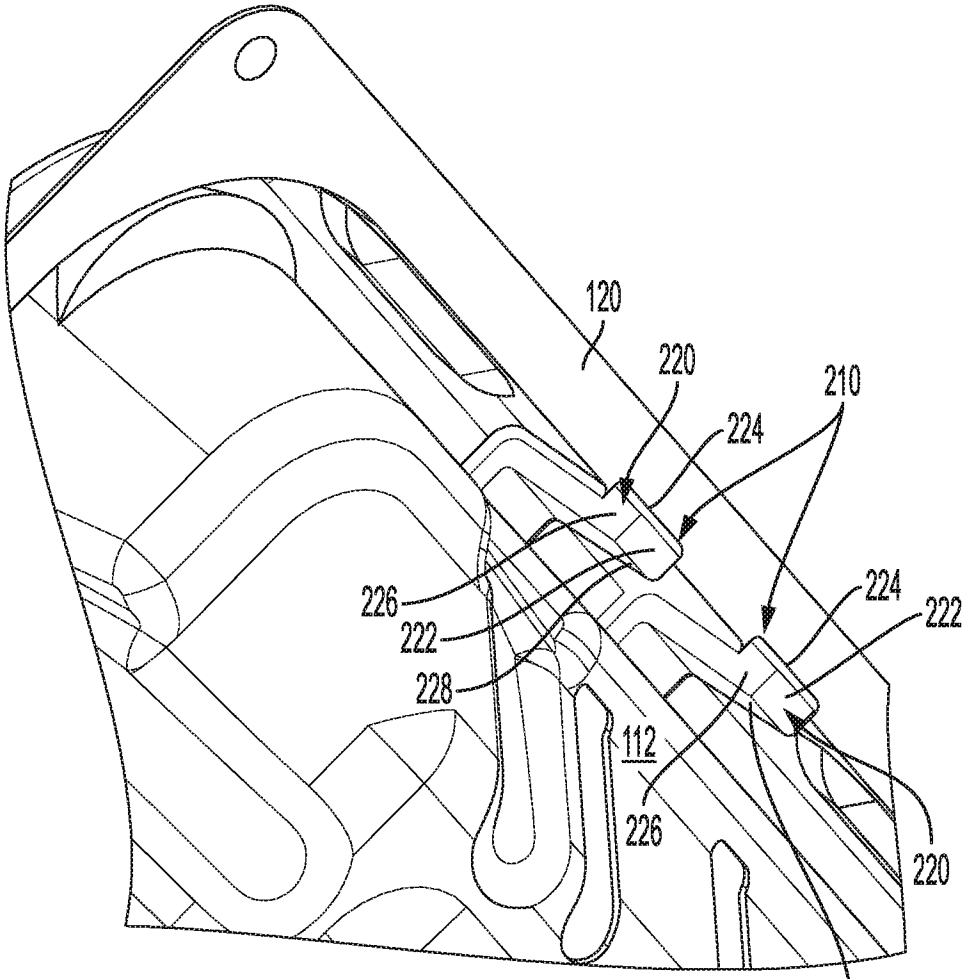
FIG. 14 is an exploded perspective view of an embodiment of a container of the invention in an open configuration.
Figure 15:
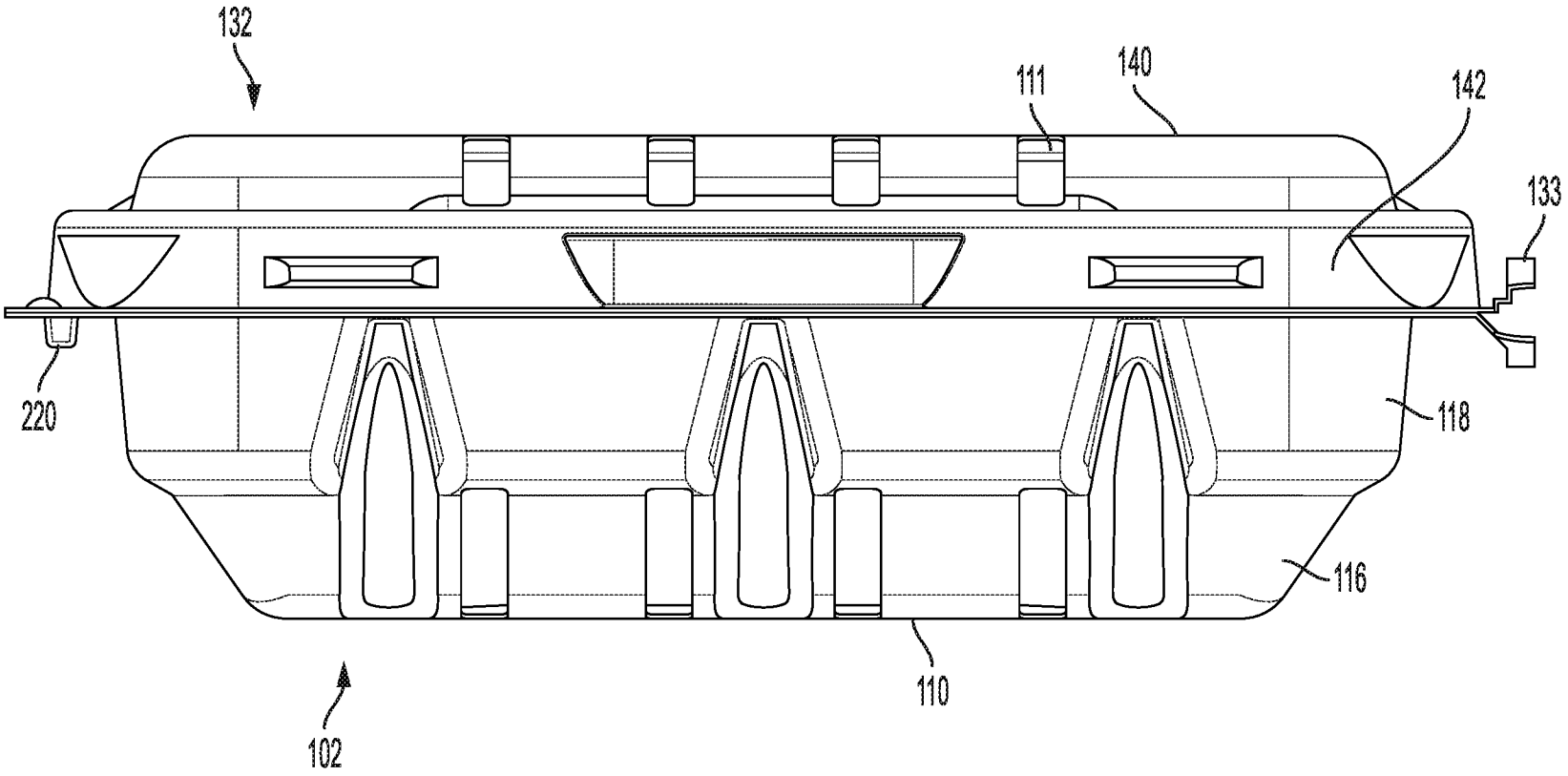
FIG. 15 is a side view of an embodiment of a container of the invention in a closed configuration.
Figure 16:
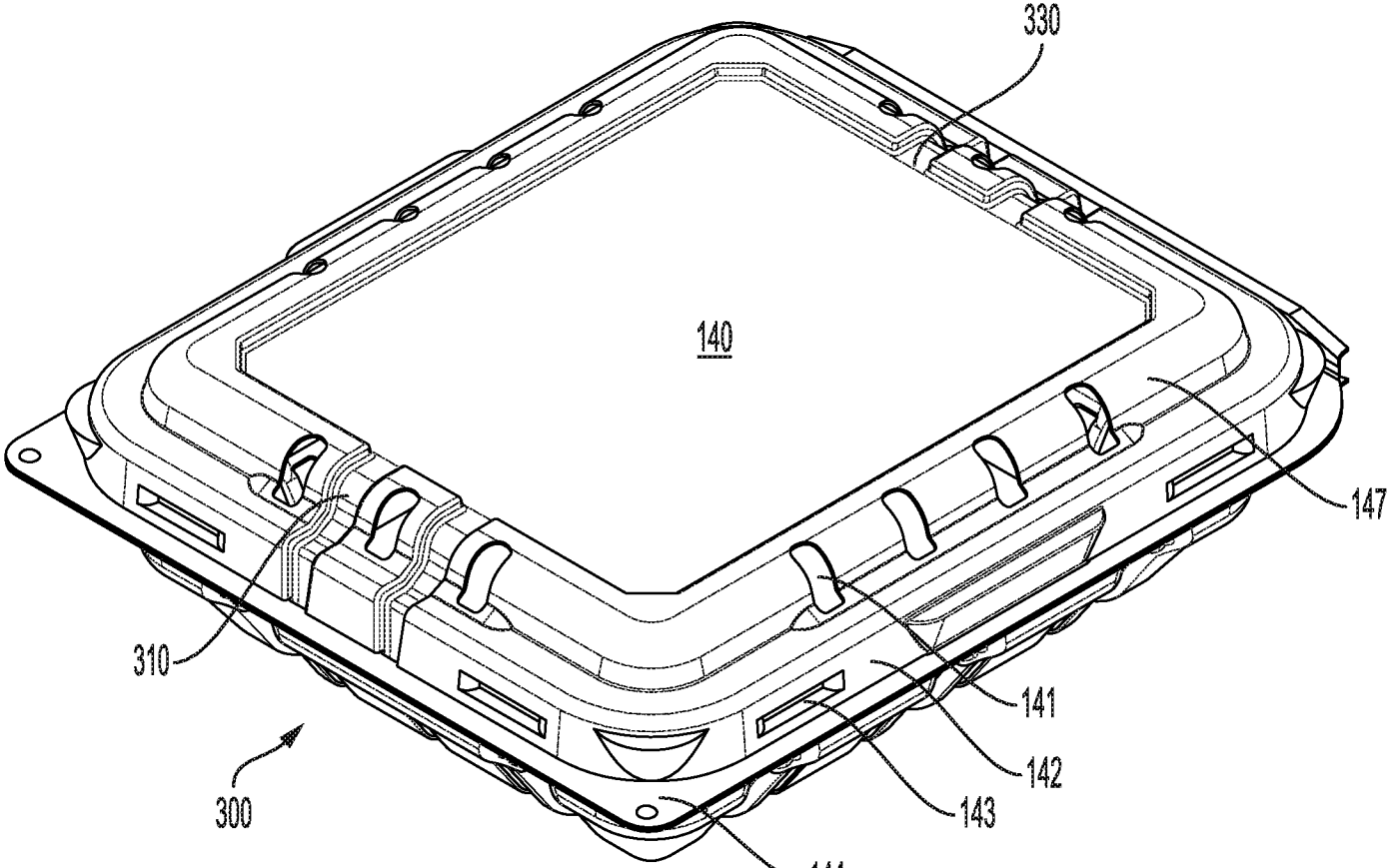
FIG. 16 is a perspective view of an embodiment of a container of the invention in a closed configuration.

FIG. 14 illustrates the underside of the tracks 210 and the pockets 220 on the exterior side of the container. As can be seen, the tracks 210 and pockets 220 may be separated from the upper base periphery portion 114 such that as space is disposed therebetween. The pocket 220 may, in an embodiment, have a front surface 224, one or more side surfaces 226, a rear surface 228, and a distal surface 222. The front surface 224 may be the most distant from the hinge 133. The distal surface 222 may be furthest from the top surface portion 217.

In an embodiment, the front surface 224 of the pocket 220 extends away from the hinge 133, into the circumference of the flange 120. That is, the front surface 224 of the pocket 220 may be disposed within the circumference of the flange 120. In an embodiment, the front surface 224 of the pocket 220 may be disposed vertically below the flange 120. In an embodiment, the distance between the rear surface 228 and the front surface 224 of the pocket 220 is greater than the depth $D_5$ of the tracks 210. In an embodiment, the distance from the top surface 217 of the tracks 210 to the distal surface 222 of the pocket 220 is equivalent to or approximately equivalent to the distance from the distal surface 322 of the rail 310 to the base 324 of the rail 310.

In an embodiment, the pockets 220 have a hollow interior. In an embodiment, the pockets 220 may have a rounded distal surface 222. In other embodiments, the distal surface 222 of the pocket 220 may be squared, with a flat bottom surface and squared sidewalls. In an embodiment, the internal width of the pockets 220 is less than the width of the upper base periphery portion 214 and the top surface portion 217 of the tracks 210.

In an embodiment, at least two tracks 210 and at least two corresponding pockets 220 are formed in the base section 102, on the sidewall 112 opposite the hinge 133 (i.e. the front wall). In an embodiment, at least two additional tracks 230 are formed in the base section 102, on the sidewall 112 nearest the hinge 133 (i.e. the rear wall). In this embodiment, the additional tracks 230 may be disposed adjacent the hinge 133. In this embodiment, the additional tracks 230 may not have pockets, but may be otherwise shaped and configured similarly to the tracks 210. The additional tracks 230 may terminate at (parallel to) the flange 120.

In an embodiment, the distance from the top surface 237 of the additional tracks 230 to the base or bottom 235 of the additional tracks 230 may be equivalent to or substantially equivalent to the distance from the top surface 332 of the additional rails 330 to the base 334 of the additional rails 330. In an embodiment, the additional tracks 230 may be positioned symmetrically to the additional rails 330. In an embodiment, the additional tracks 230 may be aligned with the additional rails 330. In an embodiment, the invention comprises two additional tracks 230 and two additional rails 330.

In an embodiment, the distance from the top surface 237 of the additional tracks 230 to the base or bottom 235 of the additional tracks 230 may be equivalent to or substantially equivalent to the distance from the top surface 217 of the tracks 210 to the flange 120. In an embodiment, the additional tracks 230 may be positioned symmetrically to the tracks 210. In an embodiment, the additional tracks 230 may be aligned with the tracks 210.

In an embodiment, each of the tracks 210, additional tracks 230, rails 310, and additional rails 330 are aligned and/or are parallel to one another. In an embodiment, the teeth 320 of the rails 310 may be shaped and configured to fit into the pockets 220 of the tracks 210. In an embodiment, when the container 100 is in a closed position, the lid flange 144 is flush with and/or parallel to the base flange 120.

In an embodiment, when the container is in a closed position—i.e. when lid section 132 is locked into base section 102, the tracks 210 and rails 310 engage to reduce and/or inhibit lateral movement of the lid section 132 relative to the base section 102 in a plane substantially parallel to the plane of the base surface 110 and the lid surface 140. In an embodiment, when the container is in a closed position—i.e. when lid section 132 is locked into base section 102, the additional tracks 230 and additional rails 330 engage to inhibit lateral movement of the lid section 132 relative to the base section 102 in a plane substantially parallel to the plane of the base surface 110 and the lid surface 140. In the closed position, the plane of the base surface 110 is parallel to the plane of the lid surface 140. In an embodiment, the engagement of the tracks 210 and rails 310 when the container is in a closed configuration provides an additional locking action and/or friction hold.

In use, the lid section 132 is pivoted to its open position and produce or other components are placed into the receptacle. In the open or the closed position, the teeth 320 and pockets 220 may extend from the lid section 132 and base section 102, respectively, in a plane which is perpendicular to the plane in which the access opening to the container lies. The lid section 132 is then pivoted to its closed positions with the teeth 320 being inserted into and/or received by their associated pockets 220. The tracks 210 and rails 310 (and optional additional tracks 230 and additional rails 330) engage one another. To disengage the teeth 320 and the pockets 220, the lid section 132 is simply pivoted about the hinge 133 to its open position.

In order to ship the filled containers 100, a plurality of containers 100 may be stacked one on top of the other. The bottom (or outer) surface of base surface 110 of one container may be seated upon the top surface (or outer surface) of the lid surface 140 of another container. In such a configuration, lateral movement of the containers within the shipping box or carton in which they are stored may occur. The weight of laterally moving stacked containers results in lateral forces being applied to the lid portions 132 of lower stacked containers. However, the engagement of the tracks 210 and rails 310, the teeth 320 and the pockets 220, as well as the additional tracks 230 and additional rails 330, in an embodiment, helps to counter these forces to reduce or inhibit lateral movement of the lid portions with respect to the receptacle in the plane in which the access opening lies.

While this specification contains many specific implementation details, these should not be construed as limitations on the scope of any features or of what may be claimed, but rather as descriptions of features specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing may be advantageous.

What is claimed is:

1. A container apparatus, comprising:

a base section defining a base surface and one or more sidewalls extending upwardly from the base surface to define a container portion having an upper base periphery circumventing the base surface, wherein the upper base periphery terminates at a top surface of the one or more sidewalls;

a base flange projecting outward from the upper base periphery;

a lid section hingedly connected to the base section, the lid section defining a lid surface and a lid periphery circumventing the lid surface, wherein a contact portion of the lid periphery aligns with the top surface of the upper base periphery when the lid section is in a hingedly closed position relative to the base section; and a lid flange projecting outward from the lid periphery;

wherein the upper base periphery and the lid periphery include an integrally formed rail system comprising:

at least one rail which extends a length which is at least from the contact portion of the lid periphery to the lid flange;

at least one tooth which extends from the at least one rail, beyond the lid flange, wherein:

the at least one rail has a width and a depth, and the depth of the at least one rail extends perpendicular to the length of the at least one rail; and at least one track which extends a length which is at least from the top surface of the upper base periphery to the base flange;

at least one pocket which extends from the at least one track, beyond the base flange, wherein:

the at least one track has a width and a depth, and the depth of the at least one track extends perpendicular to the length of the at least one track, wherein when the container is in a hingedly closed position:

the at least one rail nests within the at least one track; and the at least one tooth nests within the at least one pocket.

2. The container apparatus of claim 1, wherein the contact portion is parallel to the top surface of the one or more sidewalls.

3. The container apparatus of claim 1, wherein when the container is in a hingedly closed position, the contact portion is seated atop the top surface of the one or more sidewalls.

4. The container apparatus of claim 1, wherein when the container is in a hingedly closed position, the lid flange is parallel to the base flange.

5. The container apparatus of claim 1, wherein when the container is in a hingedly closed position, the lid flange is seated atop the base flange.

6. The container apparatus of claim 1, wherein the at least one rail extends away from the lid section, and the at least one track is recessed into the base section.

7. The container apparatus of claim 1, comprising at least two rails.

8. The container apparatus of claim 1, comprising at least two tracks.

9. The container apparatus of claim 1, additionally comprising at least one locking mechanism.

10. The container apparatus of claim 1, additionally comprising at least one rib disposed in the base section.

11. The container apparatus of claim 1, additionally comprising a hinge connecting the lid section and the base section, wherein the at least one rail is disposed in the lid periphery portion opposite the hinge and the at least one track is disposed in the upper base periphery portion opposite the hinge.

12. The container apparatus of claim 11, further comprising:

at least one additional rail disposed in the lid periphery portion adjacent the hinge; and at least one additional track disposed in the upper base periphery portion adjacent the hinge, wherein:

the at least one additional rail extends a length which is at least from the contact portion of the lid periphery to the lid flange, wherein:

the at least one additional rail has a width and a depth, and the depth of the at least one additional rail extends perpendicular to the length of the at least one rail; and the at least one additional track which extends a length which is at least from the top surface of the upper base periphery to the base flange, wherein:

the at least one additional track has a width and a depth, and the depth of the at least one additional track extends perpendicular to the length of the at least one track, wherein when the container is in a hingedly closed position, the at least one additional rail nests within the at least one additional track.

13. The container apparatus of claim 12, wherein the at least one additional rail extends away from the lid section, and the at least one additional track is recessed into the base section.

14. The container apparatus of claim 1, further comprising at least two additional rails.

15. The container apparatus of claim 1, further comprising at least two additional tracks.

16. A container apparatus, comprising:

a base section defining a base surface and one or more sidewalls extending upwardly from the base surface to define a container portion having an upper base periphery, wherein the upper base periphery terminates at a top surface of the one or more sidewalls;

a base flange projecting outward from the upper base periphery;

a hinge connecting the base section to a lid section;

the lid section defining a lid surface and a lid periphery, wherein a contact portion of the lid periphery aligns with the top surface of the upper base periphery when the lid section is in a hingedly closed position relative to the base section; and a lid flange projecting outward from the lid periphery;

wherein the upper base periphery and the lid periphery include an integrally formed rail system comprising:

at least one rail which extends a length which is at least from the contact portion of the lid periphery to the lid flange;

at least one tooth which extends from the at least one rail, beyond the lid flange, wherein the tooth extends lengthwise, and wherein:

the at least one rail has a width and a depth, the depth of the at least one rail extends perpendicular to the length of the at least one rail, and the at least one rail is disposed in the lid periphery portion opposite the hinge;

at least one track which extends a length which is at least from the top surface of the upper base periphery to the base flange;

at least one pocket which extends from the at least one track, beyond the base flange, wherein the at least one pocket extends lengthwise, and wherein:

the at least one track has a width and a depth, the depth of the at least one track extends perpendicular to the length of the at least one track, and the at least one track is disposed in the upper base periphery portion opposite the hinge, wherein when the container is in a hingedly closed position:

the at least one rail nests within the at least one track; and the at least one tooth nests within the at least one pocket;

at least one additional rail disposed in the lid periphery portion adjacent the hinge; and at least one additional track disposed in the upper base periphery portion adjacent the hinge, wherein:

the at least one additional rail extends a length which is at least from the contact portion of the lid periphery to the lid flange, wherein:

the at least one additional rail has a width and a depth, and the depth of the at least one additional rail extends perpendicular to the length of the at least one rail; and the at least one additional track extends a length which is at least from the top surface of the upper base periphery to the base flange, wherein:

the at least one additional track has a width and a depth, and the depth of the at least one additional track extends perpendicular to the length of the at least one track, wherein when the container is in a hingedly closed position, the at least one additional rail nests within the at least one additional track.

17. The container apparatus of claim 16, comprising at least two rails, at least two additional rails, at least two tracks, and at least two additional tracks.

18. The container apparatus of claim 17, wherein the at least two rails are aligned with the at least two tracks, and the at least two additional rails are aligned with the at least two additional tracks.

19. The container apparatus of claim 16, additionally comprising at least one vent disposed in at least one of the base section and the lid section.

* * * * *